US007977881B2

(12) United States Patent
Oh

(10) Patent No.: US 7,977,881 B2
(45) Date of Patent: Jul. 12, 2011

(54) PLASMA DISPLAY PANEL

(75) Inventor: Jaeyoung Oh, Gumi (KR)

(73) Assignee: LG Electronics Inc., Seoul (KR)

( * ) Notice: Subject to any disclaimer, the term of this patent is extended or adjusted under 35 U.S.C. 154(b) by 292 days.

(21) Appl. No.: 12/343,858

(22) Filed: Dec. 24, 2008

(65) Prior Publication Data

US 2009/0174328 A1 Jul. 9, 2009

(30) Foreign Application Priority Data

Jan. 8, 2008 (KR) ..... 10-2008-0002280

(51) Int. Cl.
*H01J 1/62* (2006.01)

(52) U.S. Cl. ..... 313/582; 313/586

(58) Field of Classification Search ..... 313/582, 313/584, 586

See application file for complete search history.

(56) References Cited

U.S. PATENT DOCUMENTS

2008/0284682 A1* 11/2008 Oh et al. ..... 345/60

* cited by examiner

*Primary Examiner* — Vip Patel
(74) *Attorney, Agent, or Firm* — KED & Associates, LLP

(57) ABSTRACT

A plasma display panel is provided. The plasma display panel includes a front substrate including an upper dielectric layer, a rear substrate including a lower dielectric layer, and a seal layer between the front substrate and the rear substrate. A length of a longer side of the front substrate is longer than a length of a longer side of the rear substrate, and a length of a shorter side of the front substrate is shorter than a length of a shorter side of the rear substrate. An interval between an end of the front substrate and an end of the upper dielectric layer in a direction crossing the longer side of the front substrate is less than an interval between an end of the front substrate and an end of the upper dielectric layer in a direction crossing the shorter side of the front substrate.

20 Claims, 14 Drawing Sheets

FIG. 11

| $L_1/W_1$ | Generation state of noise | Panel characteristics depending on size of pad portion |
|---|---|---|
| 0.003 | ◎ | X |
| 0.0035 | ◎ | X |
| 0.0042 | ◎ | ○ |
| 0.005 | ◎ | ○ |
| 0.0067 | ◎ | ◎ |
| 0.012 | ◎ | ◎ |
| 0.025 | ◎ | ◎ |
| 0.05 | ◎ | ◎ |
| 0.09 | ◎ | ◎ |
| 0.12 | ◎ | ◎ |
| 0.17 | ◎ | ◎ |
| 0.19 | ○ | ◎ |
| 0.21 | ○ | ◎ |
| 0.25 | ○ | ◎ |
| 0.29 | X | ○ |
| 0.32 | X | X |

FIG. 12

| $L_2/W_2$ | Generation state of noise | Panel characteristics depending on size of pad portion |
|---|---|---|
| 0.42 | ◎ | X |
| 0.5 | ◎ | X |
| 0.58 | ◎ | ○ |
| 0.63 | ◎ | ○ |
| 0.75 | ◎ | ◎ |
| 0.82 | ◎ | ◎ |
| 0.89 | ◎ | ◎ |
| 0.92 | ◎ | ◎ |
| 0.98 | ○ | ◎ |
| 0.99 | X | ○ |

PLASMA DISPLAY PANEL

This application claims the benefit of Korean Patent Application No. 10-2008-0002280 filed on Jan. 8, 2008, the entire contents of which is hereby incorporated by reference.

BACKGROUND

1. Field

Embodiments relate to a plasma display panel.

2. Description of the Background Art

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light

SUMMARY

In one aspect, a plasma display panel comprises a front substrate on which an upper dielectric layer is positioned, a rear substrate on which a lower dielectric layer is positioned, the rear substrate positioned opposite the front substrate, and a seal layer between the front substrate and the rear substrate, the seal layer including beads, wherein a length of a longer side of the front substrate is longer than a length of a longer side of the rear substrate, and a length of a shorter side of the front substrate is shorter than a length of a shorter side of the rear substrate, wherein an interval between an end of the front substrate and an end of the upper dielectric layer in a direction crossing the longer side of the front substrate is less than an interval between an end of the front substrate and an end of the upper dielectric layer in a direction crossing the shorter side of the front substrate.

In another aspect, a plasma display panel comprises a front substrate on which an upper dielectric layer is positioned, a rear substrate on which a lower dielectric layer is positioned, the rear substrate positioned opposite the front substrate, and a seal layer between the front substrate and the rear substrate, the seal layer including beads, wherein a length of a longer side of the front substrate is longer than a length of a longer side of the rear substrate, and a length of a shorter side of the front substrate is shorter than a length of a shorter side of the rear substrate, wherein a length of the lower dielectric layer is longer than a length of the upper dielectric layer in a direction crossing the longer side of the front substrate, wherein a length of the upper dielectric layer is longer than a length of the lower dielectric layer in a direction crossing the shorter side of the front substrate.

In still another aspect, a plasma display panel comprises a front substrate on which an upper dielectric layer is positioned, a rear substrate on which a lower dielectric layer is positioned, the rear substrate positioned opposite the front substrate, and a seal layer between the front substrate and the rear substrate, the seal layer including beads, wherein a length of a longer side of the front substrate is longer than a length of a longer side of the rear substrate, and a length of a shorter side of the front substrate is shorter than a length of a shorter side of the rear substrate, wherein the seal layer includes a first portion in an overlapping area between the upper dielectric layer and the lower dielectric layer and a second portion contacting at least one of the front substrate and the rear substrate, wherein a length of the first portion is longer than a length of the second portion in a direction crossing a travel direction of the seal layer.

BRIEF DESCRIPTION OF THE DRAWINGS

The accompanying drawings, which are included to provide a farther understanding of the invention and are incorporated in and constitute a part of this specification, illustrate embodiments of the invention and together with the description serve to explain the principles of the invention. In the drawings:

FIG. 11 is a table showing a relationship between a interval between an end of a front substrate and an end of an upper dielectric layer in a direction crossing a longer side of the front substrate and an interval between a seal layer and the end of the front substrate in the direction crossing the longer side of the front substrate;

FIG. 12 is a table showing a relationship between a interval between an end of a front substrate and an end of an upper dielectric layer in a direction crossing a shorter side of the front substrate and an interval between a seal layer and the end of the front substrate in the direction crossing the shorter side of the front substrate;

DETAILED DESCRIPTION OF EMBODIMENTS

Reference will now be made in detail embodiments of the invention examples of which are illustrated in the accompanying drawings.

Figure 1:
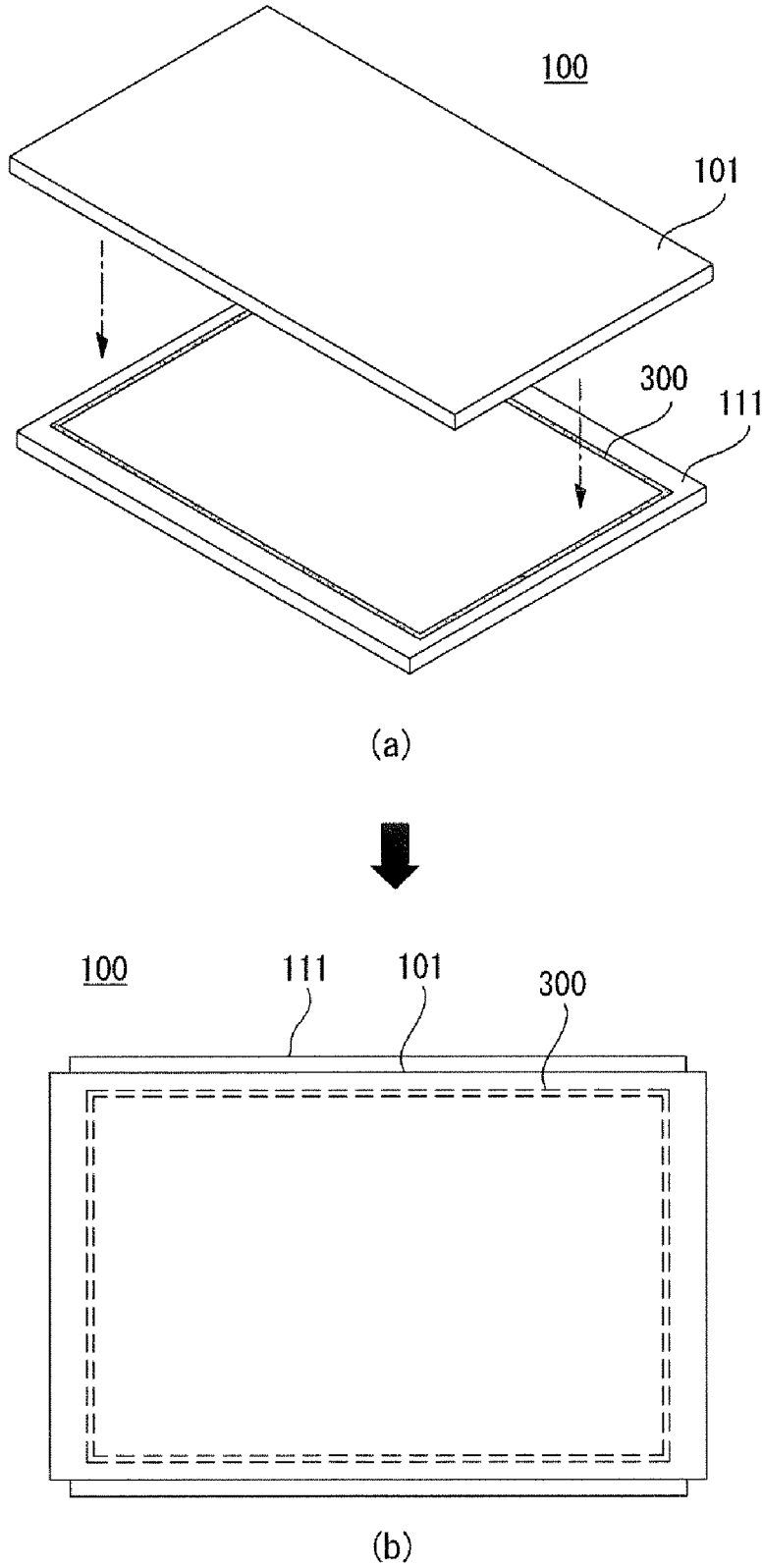
FIGS. 1 and 2 illustrate a structure of a plasma display panel according to an exemplary embodiment.
Figure 2:
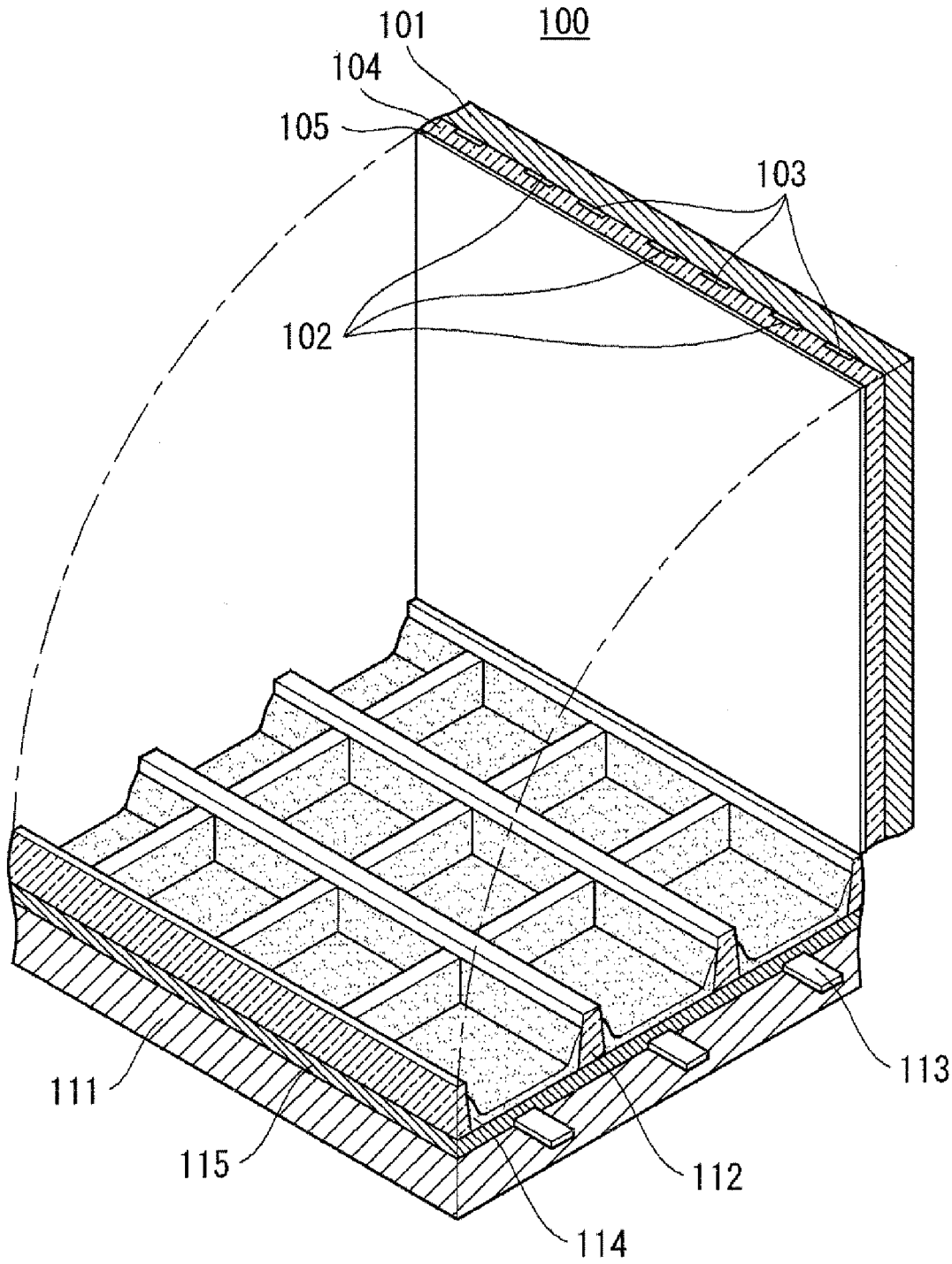

FIGS. 1 and 2 illustrate a structure of a plasma display panel according to an exemplary embodiment.

As shown in FIG. 1, a plasma display panel 100 may include a front substrate 101, a rear substrate 111, and a seal layer 300 between the front substrate 101 and the rear substrate 111.

The seal layer 300 may attach the front substrate 101 to the rear substrate 111 to seal a discharge space between the front substrate 101 and the rear substrate 111.

FIG. 2 shows in detail a structure of the plasma display panel 100.

As shown in FIG. 2, in the plasma display panel 100, a scan electrode 102 and a sustain electrode 103 may be formed on the front substrate 101 substantially parallel to each other, and an address electrode 113 is formed on the rear substrate 111 to cross the scan electrode 102 and the sustain electrode 103.

An upper dielectric layer 104 may be formed on the scan electrode 102 and the sustain electrode 103 to limit a discharge current of the scan electrode 102 and the sustain electrode 103 and to provide insulation between the scan electrode 102 and the sustain electrode 103.

A protective layer 105 may be formed on the upper dielectric layer 104 to facilitate discharge conditions. The protective layer 105 may be formed of a material having a high secondary electron emission coefficient, for example, magnesium oxide (MgO).

A lower dielectric layer 115 may be formed on the address electrode 113 to provide insulation between the address electrodes 113.

Barrier ribs 112 of a stripe type, a well type, a delta type, a honeycomb type, etc. may be formed on the lower dielectric layer 115 to partition discharge spaces (i.e., discharge cells). Hence, a first discharge cell emitting red light, a second discharge cell emitting blue light, and a third discharge cell emitting green light, etc. may be formed between the front substrate 101 and the rear substrate 111.

Widths of the first, second, and third discharge cells may be substantially equal to one another. A width of at least one of the first, second, and third discharge cells may be different from widths of the other discharge cells. For example, the first discharge cell may have a minimum width and may be smaller than widths of the second and third discharge cells. The width of the second discharge cell may be substantially equal to or different from the width of the third discharge cell. Hence, a color temperature of a displayed image may be improved.

The barrier rib 112 may have various structures as well as the structure shown in FIG. 2. For example, the barrier rib 112 may include first and second barrier ribs crossing each other. The barrier rib 112 may have a differential structure in which heights of the first and second barrier ribs are different from each other, a channel structure in which a channel usable as an exhaust path is formed on at least one of the first barrier rib or the second barrier rib, a hollow structure in which a hollow is formed on at least one of the first barrier rib or the second barrier rib, etc.

Each of the discharge cells partitioned by the barrier ribs 112 may be filled with a discharge gas.

A phosphor layer 114 may be formed inside the discharge cells to emit visible light for an image display during an address discharge. For example, first, second, and third phosphor layers that respectively produce red, blue, and green light may be formed inside the discharge cells.

FIG. 2 shows that the upper dielectric layer 104 and the lower dielectric layer 115 each have a single-layered structure. At least one of the upper dielectric layer 104 and the lower dielectric layer 115 may have a multi-layered structure.

A black layer (not shown) capable of absorbing external light may be further formed on the barrier rib 112 so as to prevent the external light from being reflected by the barrier rib 112. Further, another black layer (not shown) may be further formed at a predetermined location of the front substrate 101 corresponding to the barrier rib 112.

While the address electrode 113 may have a substantially constant width or thickness, a width or thickness of the address electrode 113 inside the discharge cell may be different from a width or thickness of the address electrode 113 outside the discharge cell. For example, a width or thickness of the address electrode 113 inside the discharge cell may be greater than a width or thickness of the address electrode 113 outside the discharge cell.

Figure 3:
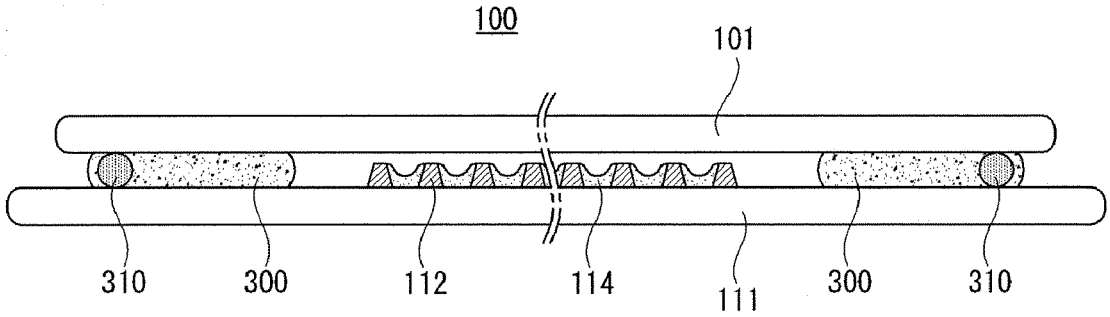
FIGS. 3 and 4 show in detail a seal layer.
Figure 4:
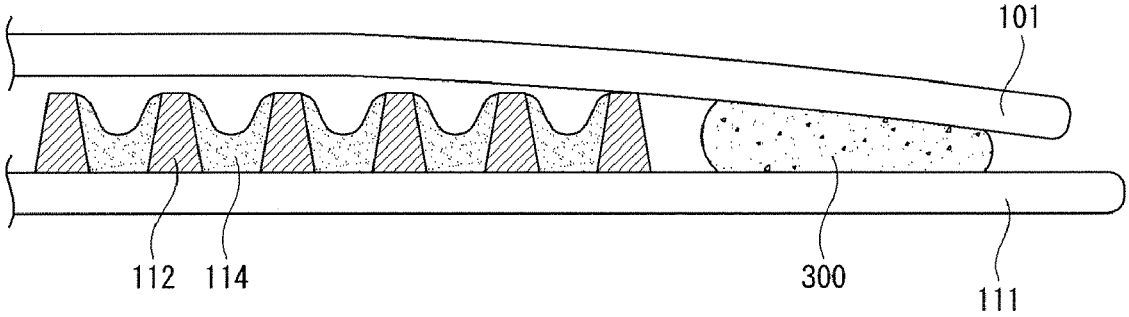

FIGS. 3 and 4 show in detail a seal layer.

As shown in FIG. 3, the seal layer 300 between the front substrate 101 and the rear substrate 111 may include a plurality of beads 310.

The beads 310 may keep an interval between the front substrate 101 and the rear substrate 111 substantially constant and may prevent the front substrate 101 from colliding with the barrier ribs 112 of the rear substrate 111 during a drive of the panel 100. Hence, generation of noise may be reduced.

A material of the beads 310 is not particularly limited. The beads 310 may be formed of a material having enough strength to bear a pressure applied by the front substrate 101 and the rear substrate 111. It may be preferable that the beads 310 is not molted when the seal layer 300 is fired The beads 310 may be formed of metal, plastic, glass, silicon, etc. having a melting point equal to or higher than 500° C.

As shown in FIG. 4, if the seal layer 300 does not include the beads 310, the seal layer 300 may become excessively thin because of a pressure applied by the front substrate 101 and the rear substrate 111. When the panel 100 is driven, an interval between the front substrate 101 and the rear substrate 111 may be non-uniform, and the front substrate 101 may frequently collide with the barrier ribs 112. Hence, an excessively loud noise may be generated.

More specifically, in fabrication of the plasma display panel 100, a seal material used to form the seal layer 300 is coated between the front substrate 101 and the rear substrate 111. Then, if a pressure is applied to the front substrate 101 or the rear substrate 111 before the seal material is cured, the front substrate 101 and the rear substrate 111 may out of alignment. However, a fixing device (not shown) such as a clip may be positioned at edges of the front substrate 101 and the rear substrate 111 to prevent the out of alignment until the seal material is cured.

While the fixing device may prevent the front substrate 101 and the rear substrate 111 to be out of alignment, the fixing device may increase a pressure applied to edges of the panel 100. Therefore, as shown in FIG. 4, the loud noise may be generated because of the very thin seal layer 300.

On the other hand, in the present embodiment, because the beads 310 provided in the seal layer 300 support the front substrate 101 and the rear substrate 111, the seal layer 300 may be prevented from being excessively thin. Therefore, the noise generated in the drive of the plasma display panel 100 may be reduced.

Figure 5A:
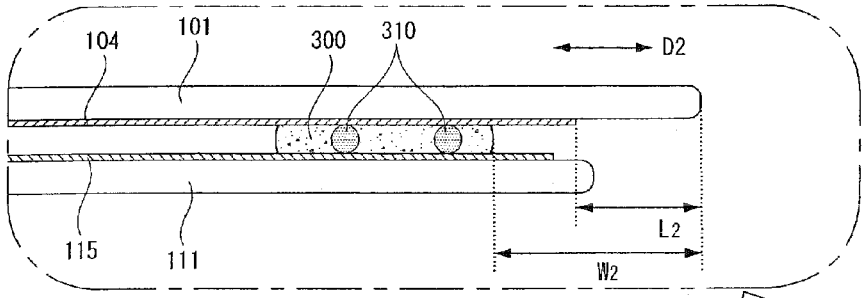
FIGS. 5A to 5C illustrate a structure of a seal layer.
Figure 5B:
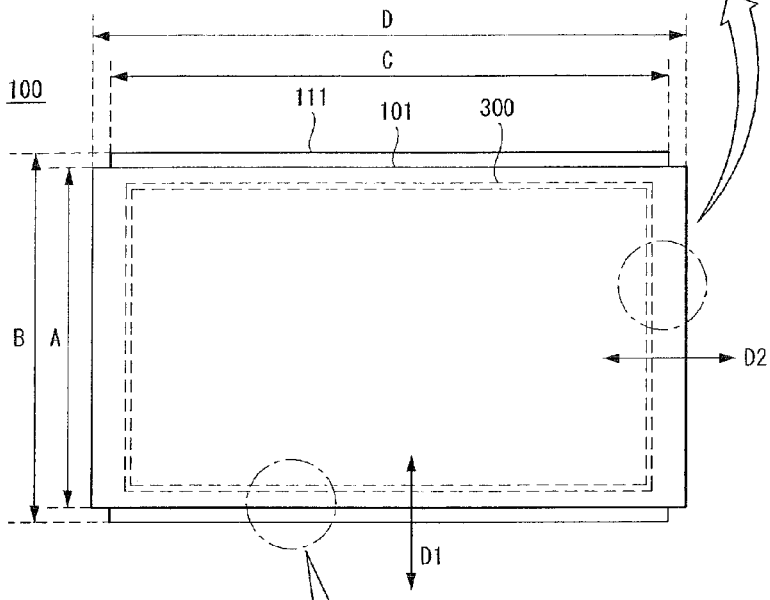
Figure 5C:
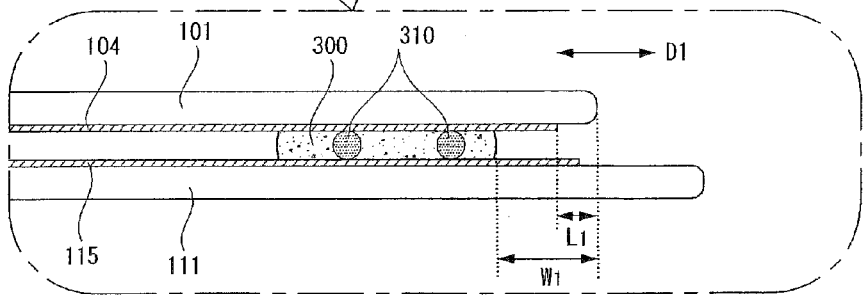

FIGS. 5A to 5C illustrate a structure of a seal layer.

As shown in FIG. 5B, a length D of a longer side of the front substrate 101 may be longer than a length C of a longer side of the rear substrate 111, and a length A of a shorter side of the front substrate 101 may be shorter than a length B of a shorter side of the rear substrate 111. In this case, the longer side of the rear substrate 111 may protrude further than the longer side of the front substrate 101, and the shorter side of the front substrate 101 may protrude further than the shorter side of the rear substrate 111.

The seal layer 300 including the beads 310 may be positioned in an area where the upper dielectric layer 104 and the lower dielectric layer 115 overlap each other between the front substrate 101 and the rear substrate 111.

In FIG. 5C, a direction crossing the longer side of one of the front substrate 101 and the rear substrate 111 is called a first direction D1, and in FIG. 5A, a direction crossing the shorter side of one of the front substrate 101 and the rear substrate 111 is called a second direction D2.

As shown in FIG. 5C, it can be seen from a cross-sectional view of the seal layer 300 in the first direction D1 that the seal layer 300 is formed in the overlapping area between the upper dielectric layer 104 and the lower dielectric layer 115. Further, as shown in FIG. 5A, it can be seen from a cross-sectional view of the seal layer 300 in the second direction D2 that the seal layer 300 is formed in the overlapping area between the upper dielectric layer 104 and the lower dielectric layer 115.

A reason why the seal layer 300 is formed in the overlapping area between the upper dielectric layer 104 and the lower dielectric layer 115 will be described with reference to FIGS. 6 and 7.

Figure 6:
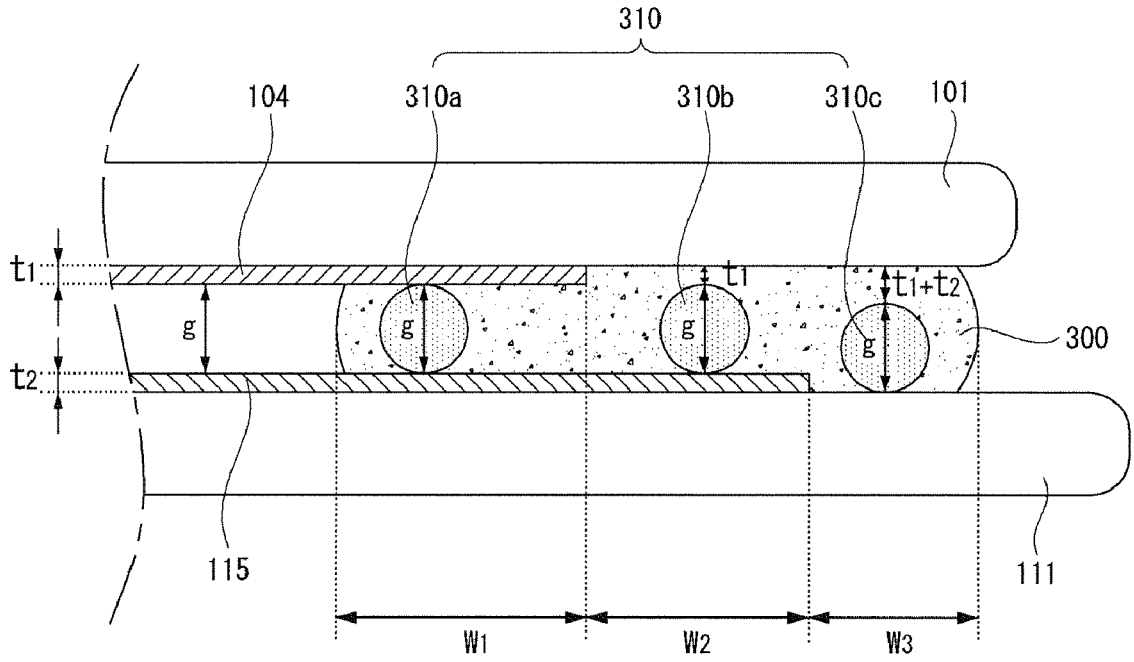
FIGS. 6 and 7 illustrate a reason why a seal layer is formed in an overlapping area between an upper dielectric layer and a lower dielectric layer.

As shown in FIG. 6, the seal layer 300 may include a first portion in an overlapping area between the upper dielectric layer 104 and the lower dielectric layer 115 and a second portion contacting at least one of the front substrate 101 and the rear substrate 111.

The second portion of the seal layer 300 may include a 2-1 portion contacting one of the front substrate 101 and the rear substrate 111 and a 2-2 portion contacting both the front substrate 101 and the rear substrate 111. In other words, the seal layer 300 between the front substrate 101 and the rear substrate 111 may be formed throughout an overlapping area P1 between the upper dielectric layer 104 and the lower dielectric layer 115, an area P2 in which one of the upper dielectric layer 104 and the lower dielectric layer 115 is omitted, and an area P3 in which both the upper dielectric layer 104 and the lower dielectric layer 115 are omitted.

In the seal layer 300, the first portion, the 2-1 portion, and the 2-2 portion may be formed in the area P1, the area P2, and the area P3, respectively.

It is assumed that the first, 2-1, and 2-2 portions include a first bead 310*a*, a second bead 310*b*, and a third bead 310*c*, respectively. It is assumed that diameters "g" of the first, second, and third beads 310*a*, 310*b*, and 310*c* are substantially equal to one another. It is assumed that even if a pressure is applied to the first second, and third beads 310*a*, 310*b*, and 310*c*, the fist, second, and third beads 310*a*, 310*b*, and 310*c* are not deformed and the diameters g are uniform It is assumed that a thickness of the upper dielectric layer 104 is t1 and a thickness of the lower dielectric layer 115 is t2.

Under the above assumptions, an interval between the upper dielectric layer 104 and the lower dielectric layer 115 may be determined as the diameter g of the first bead 310*a*. The second bead 310*b* may be spaced apart from the front substrate 101 by an interval t1. The third bead 310*c* may be spaced apart from the front substrate 101 by an interval (t1+t2).

Figure 7:
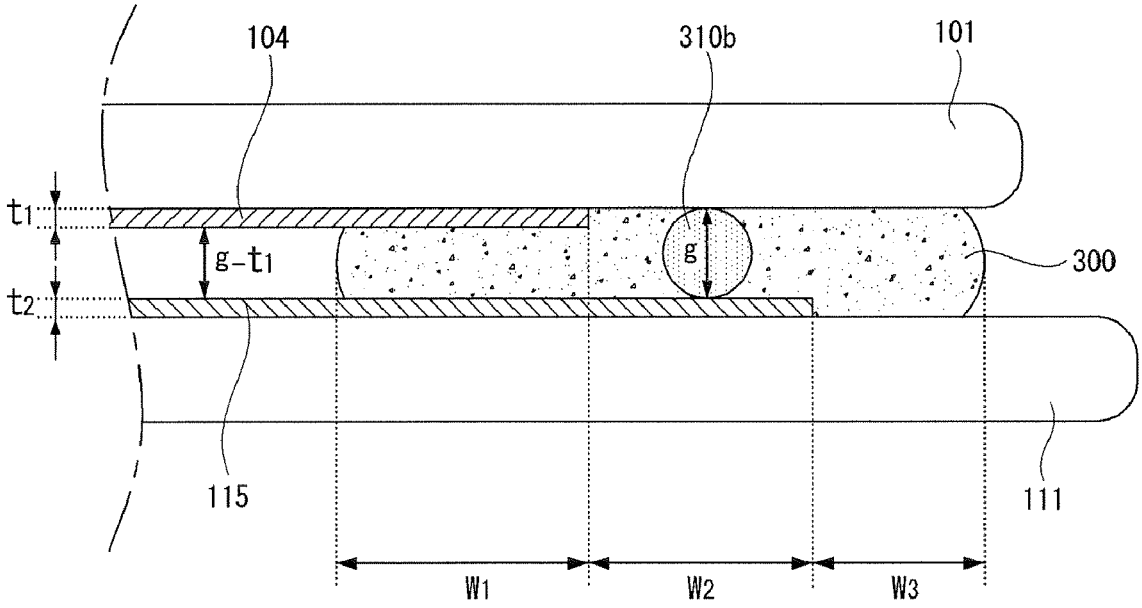

If the first bead 310*a* is not provided in the first portion, as shown in FIG. 7, an interval between the upper dielectric layer 104 and the lower dielectric layer 115 may be determined as g−t1. In this case, as shown in FIG. 4, the seal layer 300 may become excessively thin because of a pressure applied by one of the front substrate 101 and the rear substrate 111. The front substrate 101 may frequently collide with the barrier ribs 112 because of a vibration in the drive of the panel 100. Hence, the generation of noise may increase.

Considering the description of FIGS. 6 and 7, it may be preferable that the beads 310 are provided in the first portion of the seal layer 300 to reduce the generation of noise.

When a length of the first portion of the seal layer 300 is longer than a length of the second portion in a direction crossing a travel direction of the seal layer 300, there is a great possibility that the beads 310 may be provided in the first portion.

Figure 9:
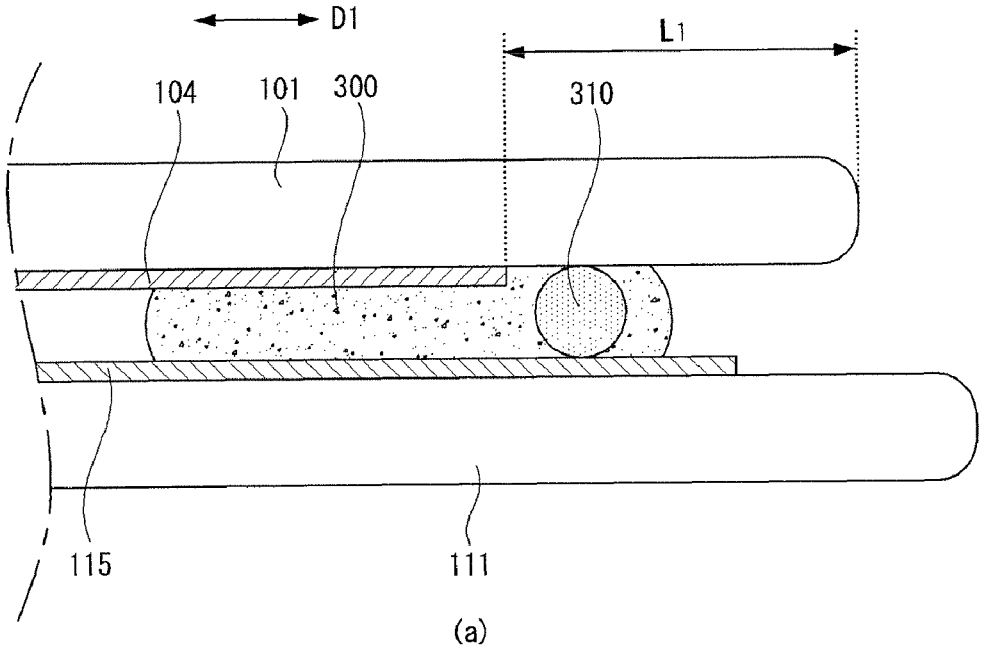
Figure 9:
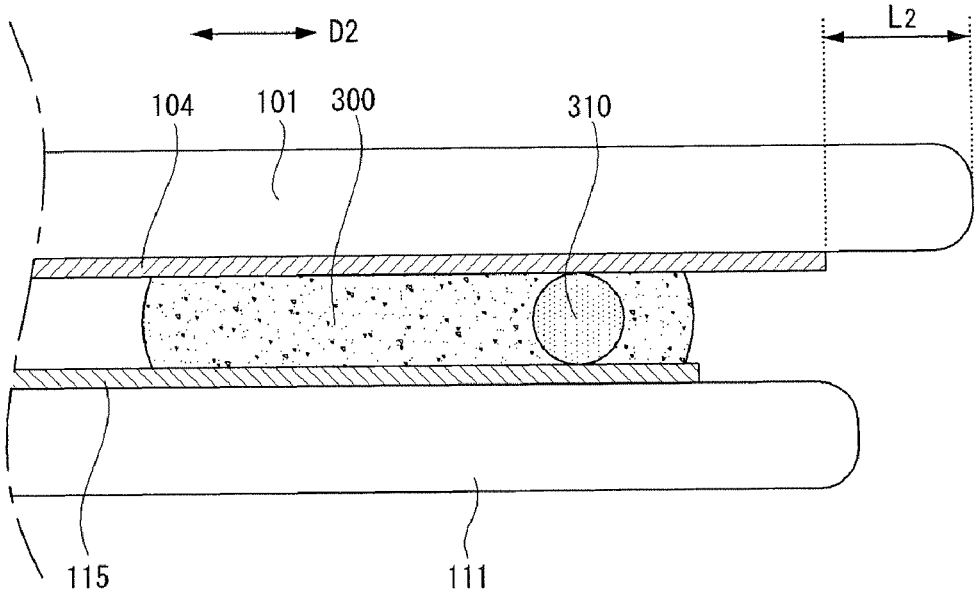
Figure 10:
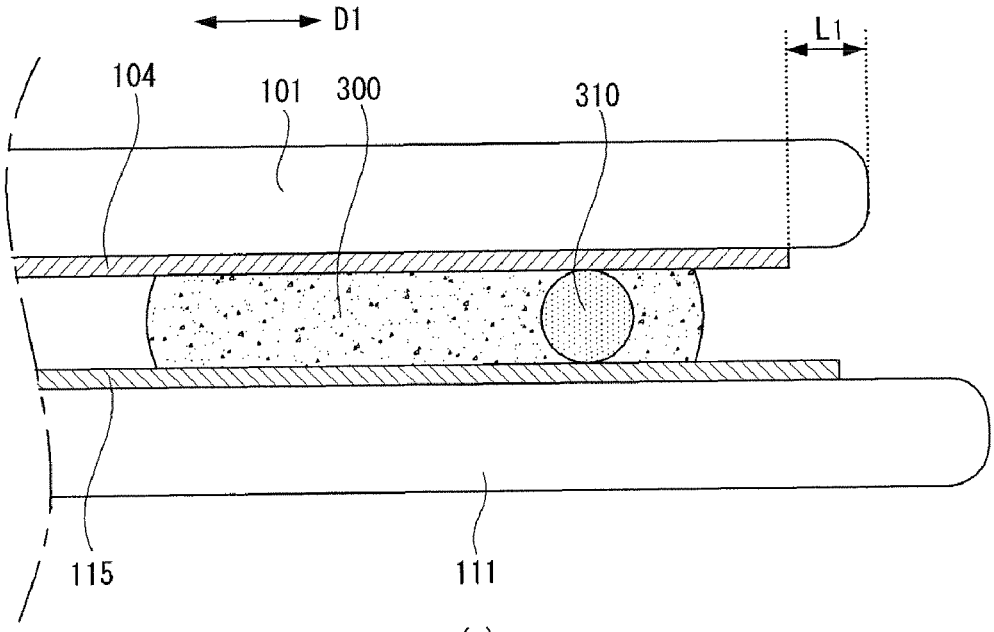
Figure 10:
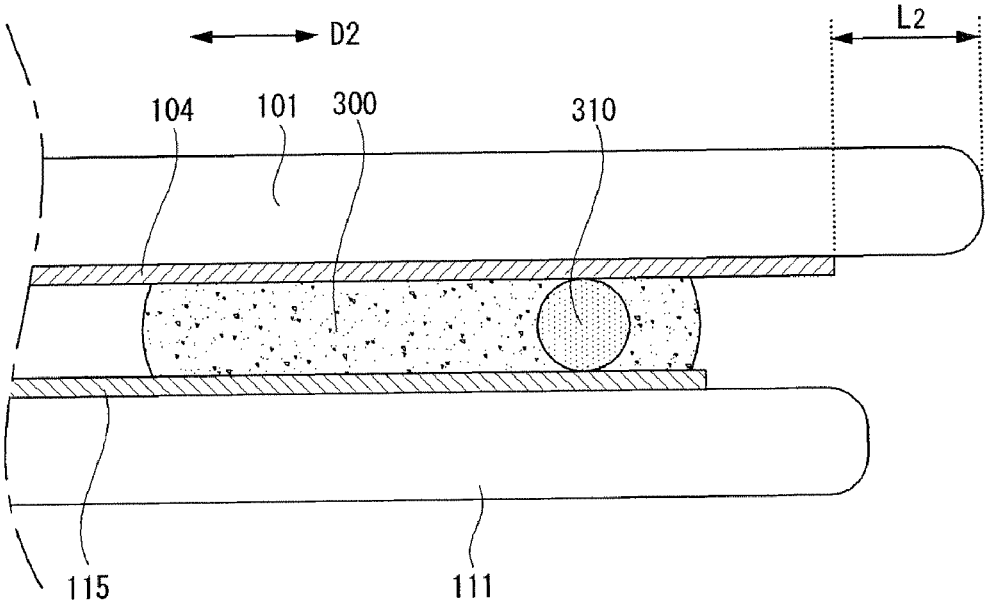

If the seal layer 300 includes only the first portion as in FIG. 5, the seal layer 300 may be formed in the overlapping area between the upper dielectric layer 104 and the lower dielectric layer 115. The generation of noise may be further reduced FIGS. 8 to 10 illustrate an interval between an end of the upper dielectric layer 104 and an end of the front substrate 101.

Figures 8A, 8B, 8C:
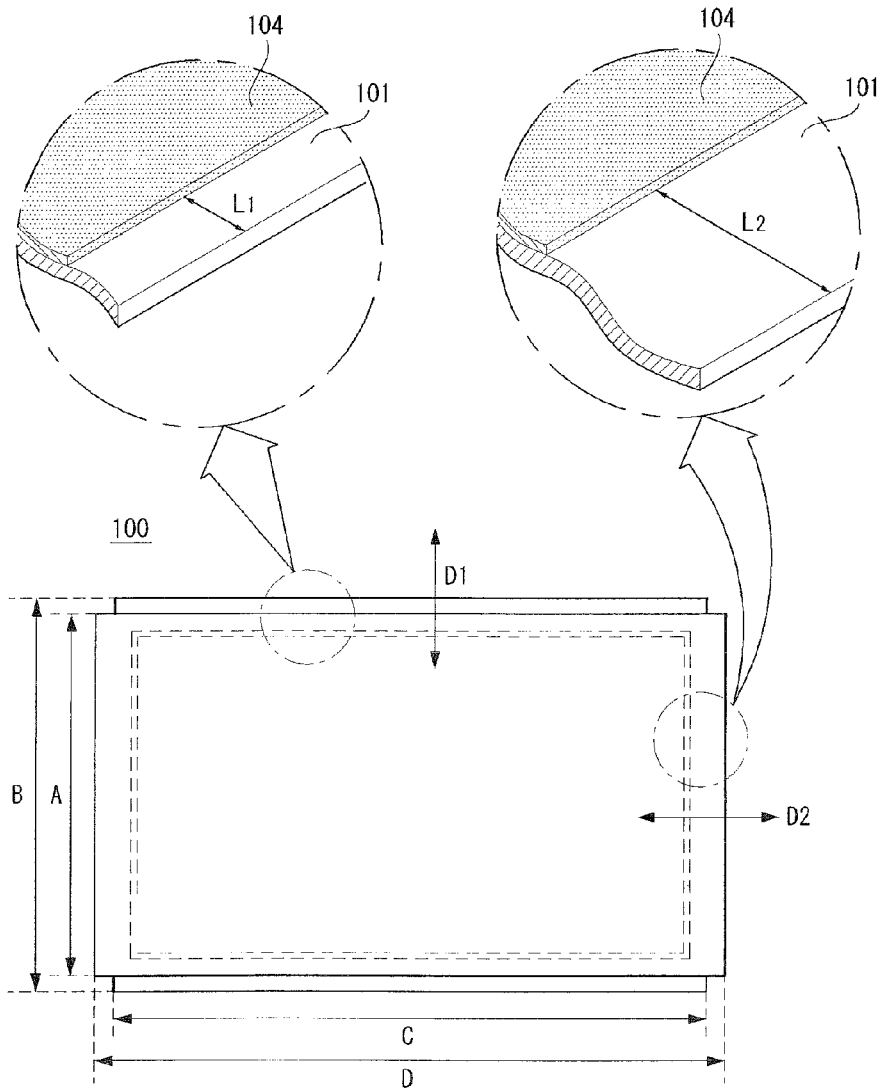
FIGS. 8A to 8C and 9 to 10 illustrate an interval between an end of an upper dielectric layer and an end of a front substrate.

As shown in FIGS. 8A to 8C, the longer side of the rear substrate 111 may protrude further than the longer side of the front substrate 101, and the shorter side of the front substrate 101 may protrude further than the shorter side of the rear substrate 111. More specifically, the length D of the longer side of the front substrate 101 may be longer than the length C of the longer side of the rear substrate 111, and the length A of the shorter side of the front substrate 101 may be shorter than the length B of the shorter side of the rear substrate 111, as shown in FIG. 8A. A relationship between the lengths of the sides of the front and rear substrates may be determined as above so as to connect the electrodes of the plasma display panel 100 to an external drive circuit that supplies driving signals to the electrodes.

A first interval L1, as shown in FIG. 8B, between an end of the front substrate 101 and an end of the upper dielectric layer 104 in a direction crossing the longer side of the front substrate 101 (i.e., the first direction D1) may be less than a second interval L2, as shown in FIG. 8C, between an end of the front substrate 101 and an end of the upper dielectric layer 104 in a direction crossing the shorter side of the front substrate 101 (i.e., the second direction D2). The interval L1 may be approximately 0.05 mm to 3 mm. The interval L2 may be approximately 7 mm to 12 mm.

As above, when the first interval L1 is less than the second interval L2, it may be easy to form the seal layer 300 in the overlapping area between the upper dielectric layer 104 and the lower dielectric layer 115.

For example, as shown in FIG. 9, when the first interval L1 is greater than the second interval L2, it may be difficult to form the seal layer 300 in the overlapping area. More specifically, the seal layer 300 may contact the front substrate 101 in an area where the rear substrate 111 protrudes further than the front substrate 101. In this case, the generation of noise may increase as illustrated in FIGS. 6 and 7.

On the other hand, as shown in FIG. 10, when the first interval L1 is less than the second interval L2, it may be easy to limit a location of the seal layer 300 to the overlapping area in an area where the rear substrate 111 protrudes further than the front substrate 101 and an area where the front substrate 101 protrudes further than the rear substrate 111.

FIG. 11 is a table showing a relationship between the first interval L1 and an interval W1 (shown in FIG. 5) between the seal layer 300 and the end of the front substrate 101 in the direction crossing the longer side of the front substrate 101.

More specifically, FIG. 11 is a table measuring a noise generated in a drive of the plasma display panel and panel characteristics depending on the size of a pad portion of the plasma display panel when a ratio L1/W1 of the first interval L1 to the interval W1 changes from 0.003 to 0.32.

A microphone is installed at 1 m ahead of the plasma display panel, and then a magnitude of a noise generated when the plasma display panel is driven is measured.

The pad portion means an area of the electrode exposed to the outside of one of the front substrate and the rear substrate. In the pad portion, an external drive circuit is electrically connected to the electrodes of the panel.

In the FIG. 11, X, ○, and ⊙ represent bad, good, and excellent states of the characteristics, respectively.

As shown in FIG. 11, when the ratio L1/W1 is 0.29 to 0.32, a generation state of noise is bad. In this case, because the first interval L1 may excessively increase, it may be difficult to form the seal layer in the overlapping area between the upper dielectric layer and the lower dielectric layer as shown in FIG. 9. Hence, the generation of noise may increase.

When the ratio L1/W1 is 0.19 to 0.25, a generation state of noise is good.

When the ratio L1/W1 is 0.003 to 0.17, a generation state of noise is excellent. In this case, because the first interval L1 may be sufficiently short, it may be easy to limit a location of the seal layer 300 in the overlapping area between the upper dielectric layer and the lower dielectric layer as shown in FIG. 10.

When the ratio L1/W1 is 0.003 to 0.0035 or 0.32, the first interval L1 may be excessively long or short If the first interval L1 is excessively less than the interval W1, the size of the pad portion may excessively increase. An increase in the size of the pad portion may cause an increase in the size of the plasma display panel, and thus the manufacturing cost may rise. If the first interval L1 is excessively greater than the interval W1, the size of the pad portion in which the drive circuit is connected to the electrodes of the panel may be excessively small. Hence, it may be difficult to smoothly connect the drive circuit to the electrodes.

When the ratio L1/W1 is 0.0042 to 0.005 or 0.29, the size of the pad portion is appropriate.

When the ratio L1/W1 is 0.0067 to 0.025, the size of the pad portion is very appropriate. In this case, an excessive increase in the size of the pad portion may be prevented because of the appropriate interval L1, and the drive circuit may be easily connected to the electrodes.

Considering the table shown in FIG. 11, the first interval L1 between the end of the front substrate and the end of the upper dielectric layer in the direction crossing the longer side of the front substrate may be 0.0042 to 0.25 times or 0.0067 to 0.17 times the interval W1 between the seal layer and the end of the front substrate in the direction crossing the longer side of the front substrate.

FIG. 12 is a table showing a relationship between the second interval L2 and an interval W2 (shown in FIG. 5) between the seal layer 300 and the end of the front substrate 101 in the direction crossing the shorter side of the front substrate 101. Since experimental methods conducted in FIGS. 11 and 12 are similar to or the same as each other, a further description may be omitted.

More specifically, FIG. 12 is a table measuring a noise generated in a drive of the plasma display panel and panel characteristics depending on the size of the pad portion when a ratio L2/W2 of the first interval L2 to the interval W2 changes from 0.42 to 0.99. In the FIG. 12, X, ○, and ⊙ represent bad, good, and excellent states of the characteristics, respectively.

As shown in FIG. 12, when the ratio L2/W2 is 0.99, a generation state of noise is bad. In this case, because the second interval L2 may excessively increase, it may be difficult to form the seal layer in the overlapping area between the upper dielectric layer and the lower dielectric layer as shown in FIG. 9. Hence, the generation of noise may increase.

When the ratio L2/W2 is equal to or less than 0.98, a generation state of noise is good.

When the ratio L2/W2 is 0.42 to 0.92, a generation state of noise is excellent. In this case, because the second interval L2 may be sufficiently short, it may be easy to limit a location of the seal layer 300 in the overlapping area between the upper dielectric layer and the lower dielectric layer as shown in FIG. 10.

When the ratio L2/W2 is 0.42 to 0.52, the second interval L2 may be excessively short. If the second interval L2 is excessively less than the interval W2, the size of the pad portion may excessively increase. An increase in the size of the pad portion may cause an increase in the size of the plasma display panel, and thus the manufacturing cost may rise.

When the ratio L2/W2 is 0.58 to 0.63, the size of the pad portion is appropriate.

When the ratio L2/W2 is 0.75 to 0.98, the size of the pad portion is very appropriate. In this case, an excessive increase in the size of the pad portion may be prevented because of the appropriate interval L2, and the drive circuit may be easily connected to the electrodes.

Considering the table shown in FIG. 12, the second interval L2 between the end of the front substrate and the end of the upper dielectric layer in the direction crossing the shorter side of the front substrate may be 0.58 to 0.98 times or 0.75 to 0.92 times the interval W2 between the seal layer and the end of the front substrate in the direction crossing the shorter side of the front substrate.

FIGS. 13A to 13C and 14A to 14B illustrate an upper dielectric layer and a lower dielectric layer.

Figure 13A:
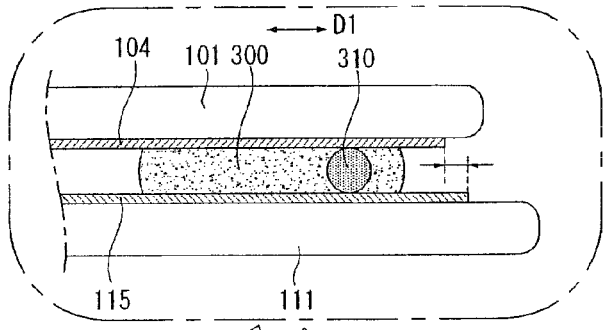
FIGS. 13A to 13C and 14A to 14B illustrate an upper dielectric layer and a lower dielectric layer.
Figure 13B:
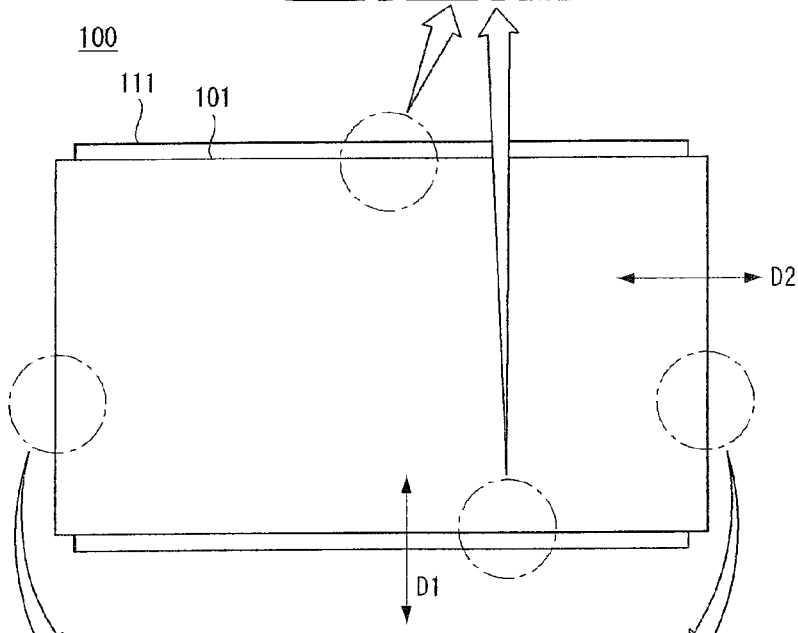
Figure 13C:
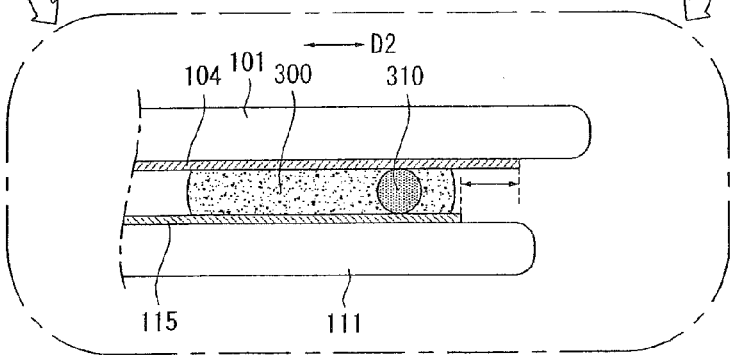

As shown in FIG. 13A, the lower dielectric layer 115 may protrude further than the upper dielectric layer 104 in the direction crossing the longer side of the front substrate 101 (i.e., the first direction D1). And as shown in FIG. 13C, the upper dielectric layer 104 may protrude further than the lower dielectric layer 115 in the direction crossing the shorter side of the front substrate 101 (i.e., the second direction D2).

As described above, when the seal layer 300 is formed between the upper dielectric layer 104 and the lower dielectric layer 115, the generation of noise may be reduced. It may be preferable that a length of the upper dielectric layer 104 and a length of the lower dielectric layer 115 are long so that the seal layer 300 is formed between the upper dielectric layer 104 and the lower dielectric layer 115.

Because, as shown in FIG. 13A, the rear substrate 111 protrudes further than the upper substrate 101 in the first direction D1, it is difficult to increase the length of the upper dielectric layer 104 in the first direction D1. Further, because, as shown in FIG. 13C, the upper substrate 101 protrudes further than the rear substrate 111 in the second direction D2, it is difficult to increase the length of the lower dielectric layer 115 in the second direction D2.

Accordingly, it may be preferable that the lower dielectric layer 115 protrudes further than the upper dielectric layer 104 in the first direction D1, and the upper dielectric layer 104 protrudes further than the lower dielectric layer 115 in the second direction D2, so that the seal layer 300 is formed between the upper dielectric layer 104 and the lower dielectric layer 115.

Figure 14A:
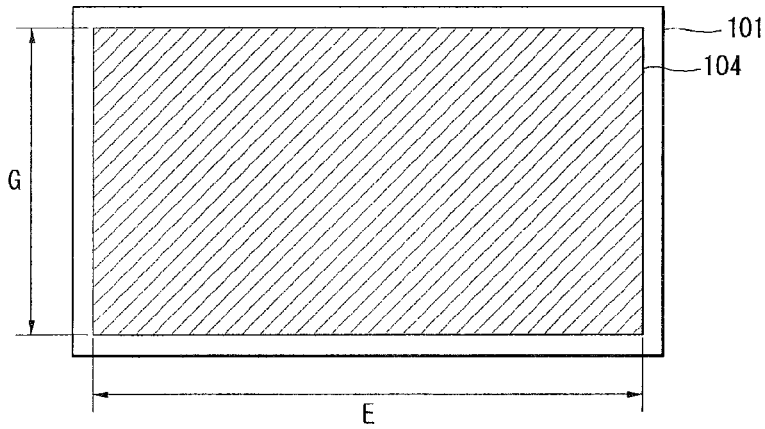
Figure 14B:
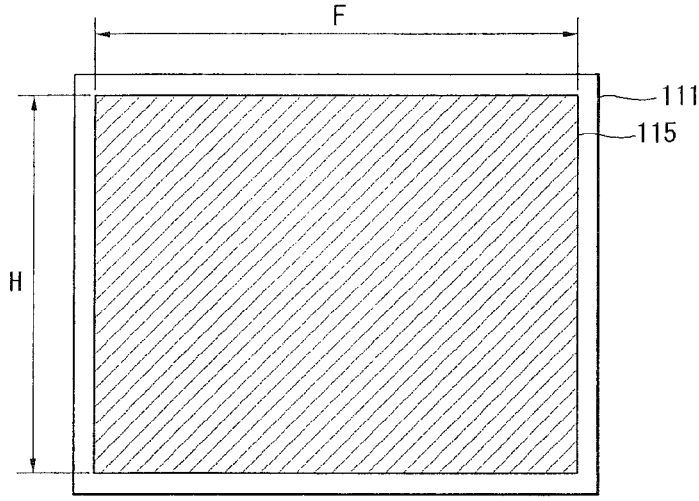

For this, it may be preferable that a length H of the lower dielectric layer 115, as shown in FIG. 14B, is longer than a length G of the upper dielectric layer 104, as shown in FIG. 14A, in the first direction D1, and a length E of the upper dielectric layer 104, as shown in FIG. 14A, is longer than a length F of the lower dielectric layer 115, as shown in FIG. 14B, in the second direction D2.

Figure 15:
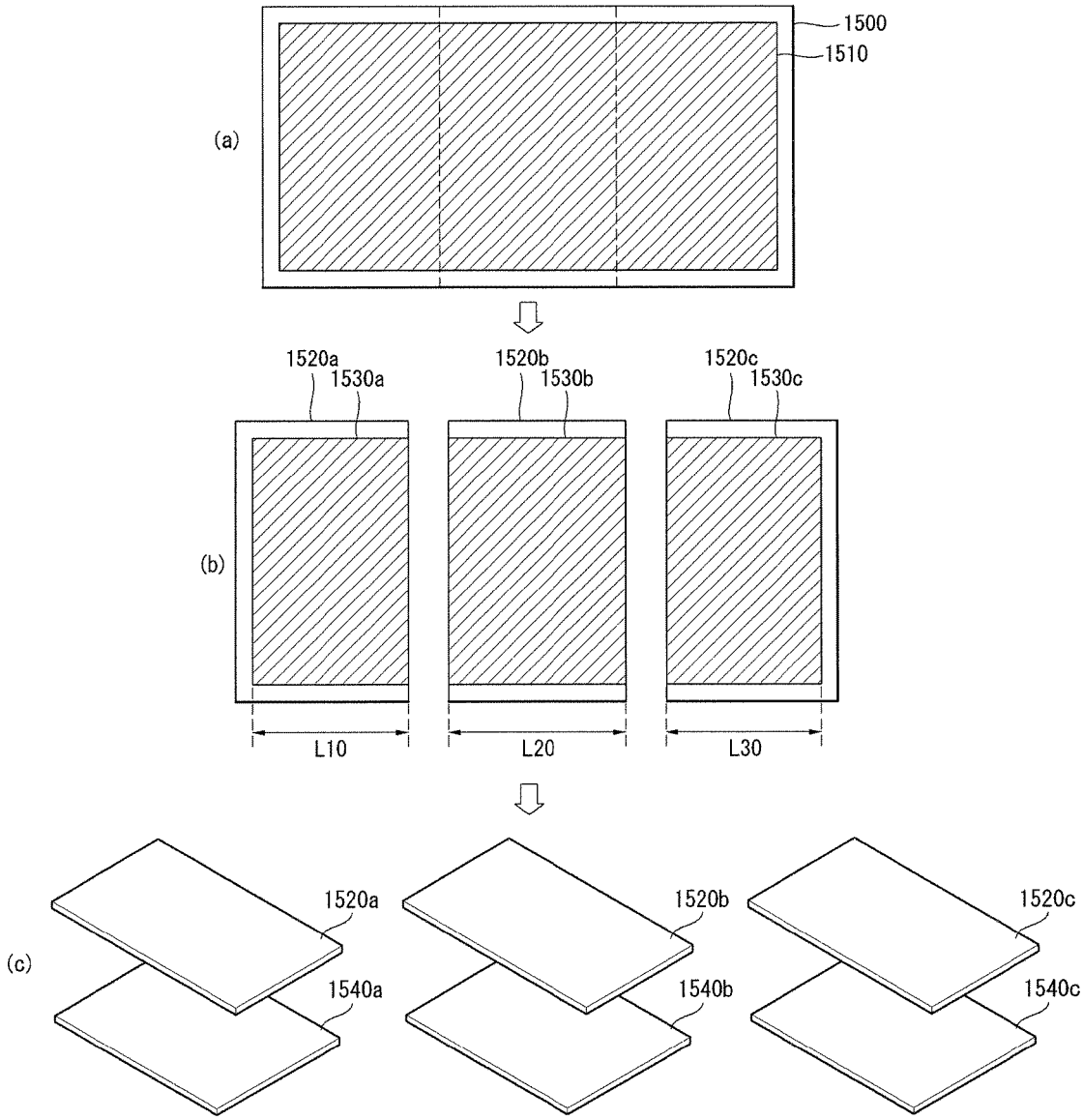
FIG. 15 illustrates an exemplary method of manufacturing a plasma display panel.

FIG. 15 illustrates an exemplary method of manufacturing the plasma display panel.

As shown in (a) of FIG. 15, a mother dielectric layer 1510 may be formed on a mother substrate 1500.

As shown in (b) of FIG. 15, a plurality of unit substrates 1520*a*, 1520*b*, and 1520*c* may be formed through cutting and grinding processes. Unit dielectric layers 1530*a*, 1530*b*, and 1530*c* may be formed on the unit substrates 1520*a*, 1520*b*, and 1520*c*, respectively. The unit dielectric layers 1530*a*, 1530*b*, and 1530*c* may be upper dielectric layers, and the unit substrates 1520*a*, 1520*b*, and 1520*c* may be front substrates.

Although it is not shown, protective layers may be formed on the unit dielectric layers 1530*a*, 1530*b*, and 1530*c*, respectively. The scan electrodes and the sustain electrodes may be formed between the unit dielectric layers 1530*a*, 1530*b* and 1530*c* and the unit substrates 1520*a*, 1520*b* and 1520*c*.

The unit substrates 1520*a*, 1520*b* and 1520*c* are called first, second, and third unit substrates 1520*a*, 1520*b* and 1520*c*, and the unit dielectric layers 1530*a*, 1530*b* and 1530*c* are called first, second, and third unit dielectric layers 1530*a*, 1530*b* and 1530*c*.

As shown in (c) of FIG. 15, the first unit substrate 1520*a* may be attached to a first unit rear substrate 1540*a*, the second unit substrate 1520*b* may be attached to a second unit rear substrate 1540*b*, and the third unit substrate 1520*c* may be attached to a third unit rear substrate 1540*c*. Hence, a plurality of unit panels may be formed.

In the second unit substrate 1520*b* positioned between the first and third unit substrates 1520*a* and 1520*c*, a length L20 of the second unit dielectric layer 1530*b* in a direction of a shorter side of the second unit substrate 1520*b* may be longer than length L10 and L30 of the first and third unit dielectric layers 1530*a* and 1530*c* in directions of shorter sides of the first and third unit substrates 1520*a* and 1520*c* through the process shown in (a) of FIG. 15.

In this case, as described in detail in FIGS. 13 and 14, it may be preferable that the length of the lower dielectric layer is longer than the length of the upper dielectric layer in the direction crossing the longer side of the front substrate, and the length of the upper dielectric layer is longer than the length of the lower dielectric layer in the direction crossing the shorter side of the front substrate. Further, as described in detail in FIG. 8, it may be preferable that the interval between the end of the front substrate and the end of the upper dielectric layer in the direction crossing the longer side of the front substrate is less than the interval between the end of the front substrate and the end of the upper dielectric layer in the direction crossing the shorter side of the front substrate.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel comprising:

a front substrate on which an upper dielectric layer is positioned;

a rear substrate on which a lower dielectric layer is positioned, the rear substrate positioned opposite the front substrate; and a seal layer between the front substrate and the rear substrate, the seal layer including beads, wherein a length of a longer side of the front substrate is longer than a length of a longer side of the rear substrate, and a length of a shorter side of the front substrate is shorter than a length of a shorter side of the rear substrate, wherein an interval between an end of the front substrate and an end of the upper dielectric layer in a direction crossing the longer side of the front substrate is less than an interval between an end of the front substrate and an end of the upper dielectric layer in a direction crossing the shorter side of the front substrate.

2. The plasma display panel of claim 1, wherein the seal layer is positioned in an overlapping area between the upper dielectric layer and the lower dielectric layer.

3. The plasma display panel of claim 1, wherein the interval between the end of the front substrate and the end of the upper dielectric layer in the direction crossing the longer side of the front substrate is 0.0042 to 0.25 times an interval between the seal layer and the end of the front substrate in the direction crossing the longer side of the front substrate.

4. The plasma display panel of claim 1, wherein the interval between the end of the front substrate and the end of the upper dielectric layer in the direction crossing the longer side of the front substrate is 0.0067 to 0.17 times an interval between the seal layer and the end of the front substrate in the direction crossing the longer side of the front substrate.

5. The plasma display panel of claim 1, wherein the interval between the end of the front substrate and the end of the upper dielectric layer in the direction crossing the shorter side of the front substrate is 0.58 to 0.98 times an interval between the seal layer and the end of the front substrate in the direction crossing the shorter side of the front substrate.

6. The plasma display panel of claim 1, wherein the interval between the end of the front substrate and the end of the upper dielectric layer in the direction crossing the shorter side of the front substrate is 0.75 to 0.92 times an interval between the seal layer and the end of the front substrate in the direction crossing the shorter side of the front substrate.

7. The plasma display panel of claim 1, wherein the interval between the end of the front substrate and the end of the upper dielectric layer in the direction crossing the shorter side of the front substrate is approximately 7 mm to 12 mm.

8. The plasma display panel of claim 1, wherein the interval between the end of the front substrate and the end of the upper dielectric layer in the direction crossing the longer side of the front substrate is approximately 0.05 mm to 3 mm.

9. The plasma display panel of claim 1, wherein the seal layer includes a first portion in an overlapping area between the upper dielectric layer and the lower dielectric layer and a second portion contacting at least one of the front substrate and the rear substrate, wherein a length of the first portion is longer than a length of the second portion in a direction crossing a travel direction of the seal layer.

10. A plasma display panel comprising:

a front substrate on which an upper dielectric layer is positioned;

a rear substrate on which a lower dielectric layer is positioned, the rear substrate positioned opposite the front substrate; and a seal layer between the front substrate and the rear substrate, the seal layer including beads, wherein a length of a longer side of the front substrate is longer than a length of a longer side of the rear substrate, and a length of a shorter side of the front substrate is shorter than a length of a shorter side of the rear substrate, wherein a length of the lower dielectric layer is longer than a length of the upper dielectric layer in a direction crossing the longer side of the front substrate, wherein a length of the upper dielectric layer is longer than a length of the lower dielectric layer in a direction crossing the shorter side of the front substrate.

11. The plasma display panel of claim 10, wherein an interval between an end of the front substrate and an end of the upper dielectric layer in the direction crossing the longer side of the front substrate is less than an interval between an end of the front substrate and an end of the upper dielectric layer in the direction crossing the shorter side of the front substrate.

12. The plasma display panel of claim 10, wherein the seal layer is positioned in an overlapping area between the upper dielectric layer and the lower dielectric layer.

13. The plasma display panel of claim 10, wherein an interval between an end of the front substrate and an end of the upper dielectric layer in the direction crossing the longer side of the front substrate is 0.0042 to 0.25 times an interval between the seal layer and the end of the front substrate in the direction crossing the longer side of the front substrate.

14. The plasma display panel of claim 10, wherein an interval between an end of the front substrate and an end of the upper dielectric layer in the direction crossing the longer side of the front substrate is 0.0067 to 0.17 times an interval between the seal layer and the end of the front substrate in the direction crossing the longer side of the front substrate.

15. The plasma display panel of claim 10, wherein an interval between an end of the front substrate and an end of the upper dielectric layer in the direction crossing the shorter side of the front substrate is 0.58 to 0.98 times an interval between the seal layer and the end of the front substrate in the direction crossing the shorter side of the front substrate.

16. The plasma display panel of claim 10, wherein an interval between an end of the front substrate and an end of the upper dielectric layer in the direction crossing the shorter side of the front substrate is 0.75 to 0.92 times an interval between the seal layer and the end of the front substrate in the direction crossing the shorter side of the front substrate.

17. The plasma display panel of claim 10, wherein an interval between an end of the front substrate and an end of the upper dielectric layer in the direction crossing the shorter side of the front substrate is approximately 7 mm to 12 mm.

18. The plasma display panel of claim 10, wherein an interval between an end of the front substrate and an end of the upper dielectric layer in the direction crossing the longer side of the front substrate is approximately 0.05 mm to 3 mm.

19. The plasma display panel of claim 10, wherein the seal layer includes a first portion in an overlapping area between the upper dielectric layer and the lower dielectric layer and a second portion contacting at least one of the front substrate and the rear substrate, wherein a length of the first portion is longer than a length of the second portion in a direction crossing a travel direction of the seal layer.

20. A plasma display panel comprising:

a front substrate on which an upper dielectric layer is positioned;

a rear substrate on which a lower dielectric layer is positioned, the rear substrate positioned opposite the front substrate; and a seal layer between the front substrate and the rear substrate, the seal layer including beads, wherein a length of a longer side of the front substrate is longer than a length of a longer side of the rear substrate, and a length of a shorter side of the front substrate is shorter than a length of a shorter side of the rear substrate, wherein the seal layer includes a first portion in an overlapping area between the upper dielectric layer and the lower dielectric layer and a second portion contacting at least one of the front substrate and the rear substrate, wherein a length of the first portion is longer than a length of the second portion in a direction crossing a travel direction of the seal layer.

* * * * *